United States Patent [19]

DeGraan

[11] Patent Number: 4,655,009

[45] Date of Patent: Apr. 7, 1987

[54] WEATHERPROOFING STRIP

[76] Inventor: Henry R. DeGraan, 20520 Walnut Dr., Walnut, Calif. 91789

[21] Appl. No.: 775,837

[22] Filed: Sep. 13, 1985

[51] Int. Cl.[4] ..... E04D 1/36

[52] U.S. Cl. ..... 52/58; 52/467; 52/469; 52/573

[58] Field of Search ..... 52/573, 58, 467, 468, 52/469, 94, 395, 403, 465, 466

[56] References Cited

U.S. PATENT DOCUMENTS 3,121,649 2/1964 Oliver ..... 52/420 X
3,277,618 10/1966 Smith ..... 52/58
4,067,155 1/1978 Ruff et al. ..... 52/466
4,189,877 2/1980 Jentoff et al. ..... 52/58
4,462,190 7/1984 Allen ..... 52/58

*Primary Examiner*—Carl D. Friedman
*Attorney, Agent, or Firm*—Edgar W. Averill, Jr.

[57] ABSTRACT

A weatherproofing strip for sealing the joint between two surfaces. The strip is an elongated, integral elastomeric strip, having a flexible central web and having a thickened portion along each edge. The thickened portion contains a deformable metal strip through which fasteners may be passed. A layer of sealant material is affixed along the underside of each longitudinal edge.

10 Claims, 5 Drawing Figures

WEATHERPROOFING STRIP

BACKGROUND OF THE INVENTION

The field of the invention is building materials and the invention relates more particularly to sealing materials typically used in weatherproofing a structure. Metallic roof flashings typically made from aluminum or other deformable metal have been used for many years to provide a weatherproof joint between a roof and a parapet or at the intersection of different roofing surfaces. Such flashing materials typically form the most vulnerable portion of a roof, and water leaks at such joints are common. Improved materials have recently been made available which permit improved roofing surfaces, and the use of a membrane or a single ply roofing material made from an elastomeric sheet provides a high degree of weatherability as compared to the older style of asphalt built-up roof. In spite of the improvement in roofing materials, the problem of sealing adjacent surfaces remained and a better way to weatherproof such joints is needed.

Another common sealing problem comprises expansion joints in large surfaces which often are filled with a flexible sealant which is expected to deform to follow the opening and closing at the expansion joint. Such sealants, typically, are not capable of providing satisfactory sealing characteristics against the possibility of the leakage of water.

SUMMARY OF THE INVENTION

It is an object of the present invention to provide a weatherproofing strip for weatherproofing joints between surfaces including expansion joints.

The present invention is for a weatherproofing strip for sealing the joint between two surfaces or the intersection of adjacent members on one surface. This is an elongated, integral elastomeric strip having a flexible central web and at each longitudinal edge having a thickened portion having a deformable metallic strip in the center thereof and a strip of sealant material affixed along the underside of the strip near each longitudinal edge. The present invention also includes the weatherproofed joint made from this strip which includes a plurality of fasteners which pass through each of the thickened portions, through each of the deformable metallic strips and through each of the strips of sealant material and into the surfaces. The result is a weatherproofed joint having exceptionally long life and excellent sealant characteristics.

DESCRIPTION OF THE PREFERRED EMBODIMENTS

Figure 1:
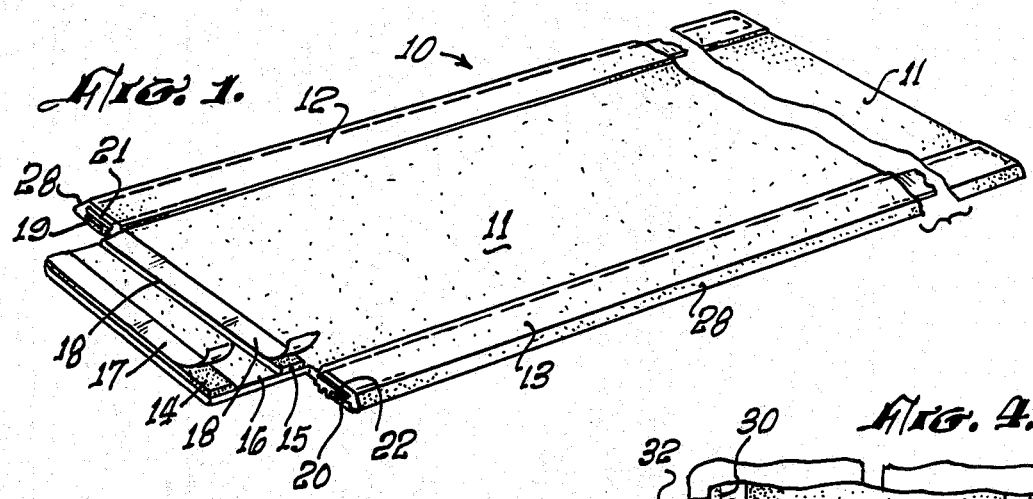
FIG. 1 is a perspective view of the weatherproof strip of the present invention.

The weatherproof strip of the present invention is shown in perspective view in FIG. 1 and indicated generally by reference character 10. Strip 10 is fabricated from an elastomer such as EPDM having excellent weathering characteristics. Strip 10 has a central web 11 and thickened edges 12 and 13. A pair of sealant strips 14 and 15 are adhered to the upper surface of an extended tongue portion 16 of web 11. Strips 14 and 15 are preferably covered with a release paper strip indicated by reference characters 17 and 18.

Figure 3:
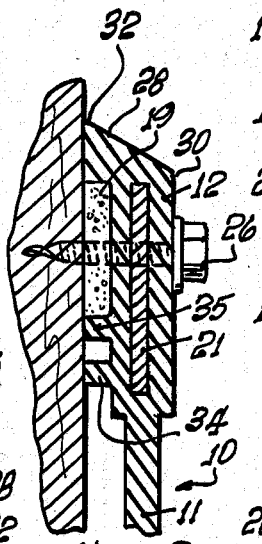
FIG. 3 is a cross-sectional view taken along line 3—3 of FIG. 2.

A pair of sealant strips 19 and 20 are adhered to the underside of strip 10 and the location of such strips is shown in detail in FIG. 3. A pair of deformable metal strips 21 and 22 are positioned in the center of thickened edges 12 and 13 and serve to distribute the load applied by a plurality of fasteners which are screwed or driven through the thickened edges.

Figure 2:
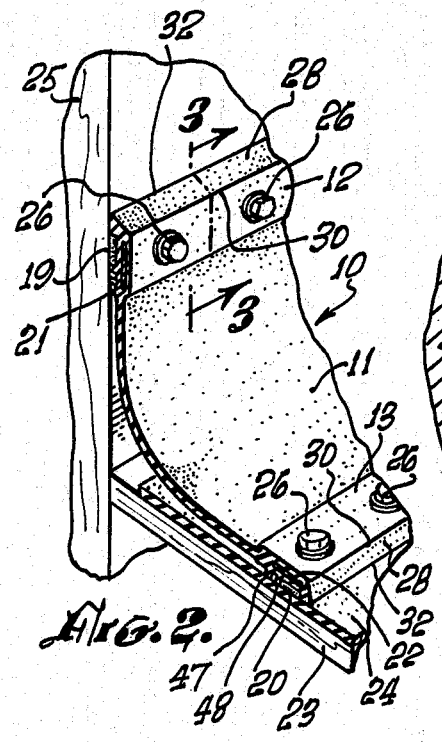
FIG. 2 is a perspective view, partly in cross-section, of the weatherproof strip of the present invention affixed over the intersection of a roof and a parapet.

The use of the strip 10 over the intersection of a roofing surface and a parapet is shown in cross-sectional view in FIG. 2. There a roof panel 23 supports a membrane 24 comprising a single-ply roofing material also fabricated from EPDM. Roof panel 23 abuts a parapet 25 at the edge thereof. A plurality of fasteners 26 pass through both of the thickened edges 12 and 13 including passing through the metallic strips and sealant strips as shown best in FIG. 3.

In FIG. 3 it can be seen that fastener 26 passes through the thickened edge 12, the deformable metallic strip 21, the sealant strip 19 and into the parapet. Fastener 26 may be a hexagonal-headed screw, a nail or any common fastener used in the roofing industry. The metallic strip should be made from a metal which is easily deformed so that it may be shaped to fit the contour of the surface being sealed. It has been found that 26-gauge steel is satisfactory for this use. Alternatively, aluminum strips may be used as may other deformable metals.

The sealant material 19 should be fabricated from a material which has excellent weathering capabilities and which also is flexible and deformable to seal the edge against the roof or other surface in all different temperatures. An isobutylene sealant has been found satisfactory for this use.

Another important feature of the present invention is shown in FIG. 3 where it can be seen that the thickened edges have a beveled outer edge 28 which passes from the outer corner 30 to the lowermost edge 32, effectively blocking off ultraviolet rays from the sealant material. This beveled outer edge also reduces the possibility that water will be retained at a vertical intersection as between the intersection of parapet 25 and the lower corner 32.

An additional sealing rib 34 is positioned along the under, inner edge of thickened edge 12 and an adjacent caulk retaining and sealing rib 35 is positioned along the inner edge of sealant strip 19. These sealing tongues provide additional sealing between the inner portion of the strip and the thickened edges. In addition, rib 35 helps to retain the sealant 19 and to help force it into any surface irregularities in the surface to be sealed. Analogous sealing rib 47 and caulk retaining and sealing rib 48 are formed on the under surface of thickened edge 20.

Figure 5:
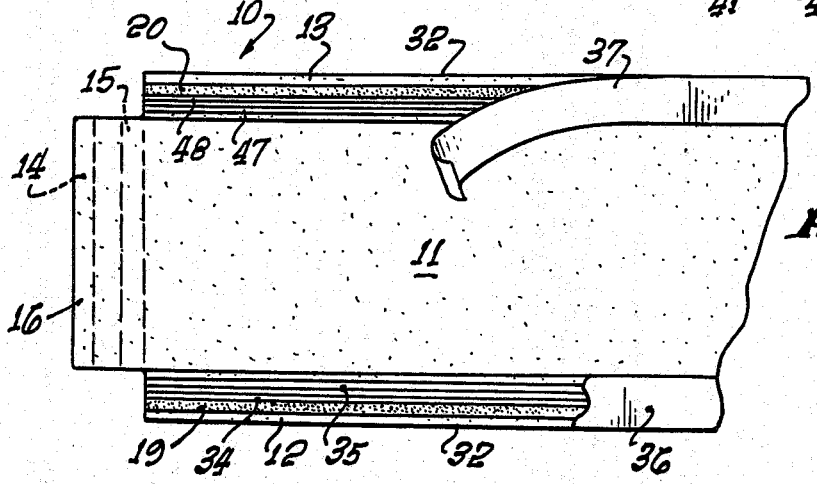
FIG. 5 is a bottom view of the strip of FIG. 1.

Weatherproof strip 10 is shown in bottom view in FIG. 5 where it can be seen that sealant strips 19 and 20 are covered with release paper strips 36 and 37. Weatherproof strips 10 are provided in substantial lengths to reduce the number of joints between adjacent strips. Lengths of fifty feet are contemplated.

Figure 4:
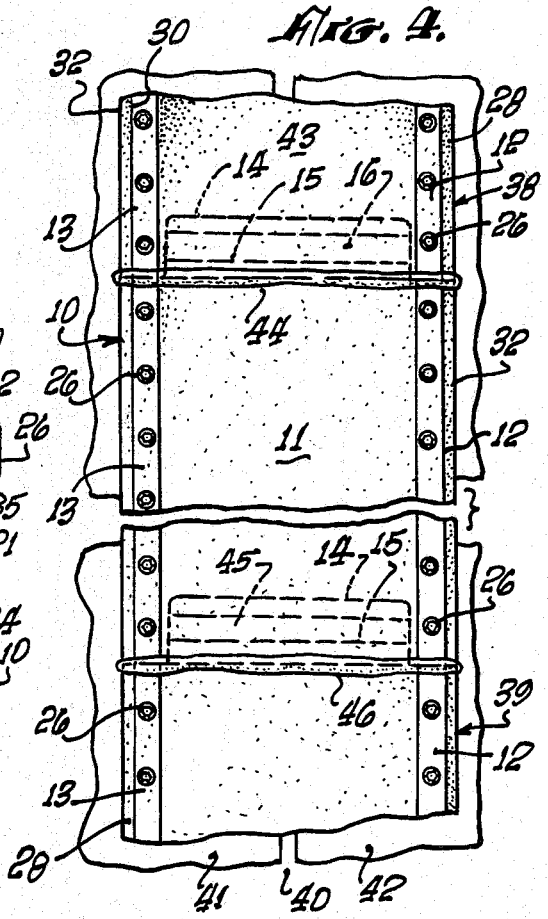
FIG. 4 is a plan view of a plurality of the strips of FIG. 1 placed over an expansion joint.

In FIG. 4, weatherproof strip 10 is joined to strips 38 and 39 and used to cover an expansion joint 40 between surfaces 41 and 42. The tongue 16 of strip 11 is placed under the web 43 and release papers 17 and 18 have been removed so that sealant strips 14 and 15 may abut the underside of web 43 and provide a seal between these two members. As is evident from FIG. 3, there is sufficient space under web 11 for the placement of a tongue of an adjacent strip. A layer of sealant 44 has been placed over the intersection. Standard caulking materials such as a standard urethane caulk are satisfactory for use as sealant 44. Similarly, tongue 45 of strip 39 is placed under web 11 and a sealant strip 46 covers this intersection. A plurality of fasteners 26 are placed through the thickened edges and a spacing of three to four inches is satisfactory for most surfaces.

The particular dimensions of the sealant strip are not critical and are dependent upon the joint to be sealed. Typically, however, an overall width of approximately nine inches with each of the thickened areas being about one-inch in width has proved satisfactory. The thickness of the web is typically about one-sixteenth of an inch, and the thickness of the thickened edge at its thickest point is about one-fourth of an inch. The thickness of the sealant should be sufficient so that it protrudes slightly below the bottom surface of the strip so that it may flow to fill any irregularities or depressions in the surface being sealed.

The strip of the present invention provides an attractive sealing joint of exceptionally long life. The strip is exceptionally easy to install and is particularly adaptable for the newer types of membrane or single-ply roofing materials.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A weatherproofing strip for sealing the joint between two surfaces or the intersection of adjacent members on one surface, said strip comprising:

an elongated, integral elastomeric strip having a flexible central web and at each longitudinal edge having a thickened portion having a deformable metallic strip in the center thereof and a strip of sealant material having an upper portion and sides, said sealant material being affixed along the underside of the elastomeric strip near each longitudinal edge, each of said strips of sealant material being confined in a recessed channel surrounding the upper portion of said strips of sealant material and having an elastomeric caulk retaining and sealing rib along each side of each of said strips of sealant material and said strips of sealant material being positioned below said deformable metallic strips.

2. The weatherproofing strip of claim 1 further including a bevelled surface along each outer longitudinal edge directed downwardly and outwardly with respect to the upper corners and terminating at the lowermost portion of the strip whereby the sealant is protected from ultraviolet rays.

3. The weatherproofing strip of claim 1 further including a caulk retaining and sealing rib adjacent each recessed channel near the inner edge of each channel.

4. The weatherproofing strip of claim 3 further including an additional sealing rib adjacent said caulk retaining and sealing rib, said additional sealing rib being located on the underside of each thickened portion at the web side thereof.

5. The weatherproofing strip of claim 1 further including a tongue at one end of said strip, said tongue having a width equal to the width of said flexible central web and said tongue comprising an extended length of said flexible central web.

6. The weatherproofing strip of claim 5 further including at least one strip of sealant material adhered to the upper surface of said tongue, said sealant strip being oriented at a right angle with respect to the longitudinal axis of said strip.

7. A weatherproofed joint having a weatherproofing strip affixed over a joint between two surfaces, said joint comprising:

an elongated, integral elastomeric strip having a flexible central web, having first and second thickened portions at the two longitudinal edges and having a first and second deformable metallic strip in the center of the first and second thickened portions, and first and second strips of sealant material having an upper portion and sides, said strips of sealant material being affixed along the underside of the elastomeric strip near each longitudinal edge, each of said strips of sealant material being confined in a recessed channel surrounding the upper portion of said strips of sealant material and having an elastomeric caulk retaining and sealing rib along each side of each of said strips of sealant material and said strips of sealant material being positioned below said deformable metallic strips, the first of said thickened portions having a first plurality of fasteners passing through the first thickened portion, through the first deformable metallic strip and through the first strip of sealant material and into the first of said surfaces, and a second plurality of fasteners passing through the second thickened portion, through the second deformable metallic strip and through the second strip of sealant material and into the second of said surfaces.

8. The weatherproofed joint of claim 7 wherein said fasteners are separated about four inches apart.

9. The weatherproofed joint of claim 7 wherein the first and second thickened portions are bevelled outwardly and downwardly from the outer and upper corners to the lowermost part of the weatherproof strip.

10. The weatherproofed joint of claim 7 further including an additional sealing rib adjacent said caulk retaining and sealing rib, said additional sealing rib being located on the underside of each thickened portion at the web side thereof.

* * * * *